US007591656B1

(12) United States Patent
Gretz

(10) Patent No.: US 7,591,656 B1
(45) Date of Patent: Sep. 22, 2009

(54) GROUNDING TERMINAL BLOCK ASSEMBLY FOR MULTIPLE SERVICES

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 12/288,968

(22) Filed: Oct. 24, 2008

Related U.S. Application Data

(63) Continuation-in-part of application No. 12/287,244, filed on Oct. 7, 2008, now Pat. No. 7,537,467.

(51) Int. Cl.
*H01R 4/66* (2006.01)
*H01R 11/09* (2006.01)
*H01R 4/36* (2006.01)

(52) U.S. Cl. ..... 439/108; 439/706; 439/810

(58) Field of Classification Search ..... 439/108, 439/95, 721, 540.1, 814, 797, 798, 810, 709; 361/119
See application file for complete search history.

(56) References Cited

U.S. PATENT DOCUMENTS 4,104,703 A 8/1978 Hotchkiss
4,630,882 A * 12/1986 Naylor et al. ..... 439/444
4,697,720 A 10/1987 Hotchkiss
5,430,248 A 7/1995 Levy
5,994,989 A * 11/1999 Rowe et al. ..... 335/202
6,176,747 B1 * 1/2001 Rowe et al. ..... 439/721
6,222,717 B1 * 4/2001 Waas et al. ..... 361/119
6,497,592 B1 * 12/2002 Beadle ..... 439/814
6,551,135 B2 4/2003 Stekelenburg
7,011,551 B2 * 3/2006 Johansen et al. ..... 439/709
7,121,901 B1 10/2006 Chen
7,175,484 B1 * 2/2007 Tamm et al. ..... 439/798
2004/0229518 A1 * 11/2004 Landis et al. ..... 439/709

* cited by examiner

*Primary Examiner*—Chandrika Prasad

(57) ABSTRACT

A grounding terminal block assembly for securing to an existing ground wire to provide additional connection points for electrical systems such data, cable TV, and phone lines. The grounding terminal block assembly includes an elongated grounding bar with a plurality of threaded bores extending laterally therein. Fasteners are threaded into one or more of the threaded bores to provide connection points for ground wires from one or more electrical systems. A channel on one end of the grounding bar includes a slotted headless set screw for establishing a secure connection to an existing ground wire. Legs are provided integral with the grounding bar for providing direct connection to a wall or other structure. A detachable insulating cover is secured to the grounding bar to shield the grounding body and all wiring connections.

20 Claims, 8 Drawing Sheets

GROUNDING TERMINAL BLOCK ASSEMBLY FOR MULTIPLE SERVICES

This application is a Continuation-In-Part of U.S. patent application Ser. No. 12/287,244 filed Oct. 7, 2008 now U.S. Pat. No. 7,527,467 and still pending the entire contents of which are incorporated herein by reference.

FIELD OF THE INVENTION

This invention relates to terminal blocks for electrical service boxes and specifically to a grounding terminal block assembly that will connect several devices to a service box.

BACKGROUND OF THE INVENTION

The National Electrical Code (NEC) now requires the grounding of data, cable TV, and phone lines. Grounding is the establishment of an electrical connection to earth through a path of sufficiently low impedance. As it relates to data, cable TV, and phone lines, the purpose of grounding is to assist in preventing the destruction of electrical components and property damage from superimposed voltage from lightning and voltage transients. Grounding the various connections to the earth also helps in reducing static charges on equipment surfaces to ensure the proper performance of sensitive electronic equipment. Grounding communications equipment to the earth reduces high voltage from lightning and keeps it from entering into the building or structure via metal cables or raceways. If the metal portions of communication equipment are not grounded in accordance with the NEC, a significant amount of the high energy from the lightning strike will be dissipated within the structure, which can result in equipment and property damage as well as the potential for electric shock. Grounding also helps establish a zero voltage reference point to ensure proper performance of sensitive communications equipment.

In a parent application for patent, which has been incorporated herein by reference thereto, there was provided a grounding block assembly for multiple services that included a die-cast tubular body with a plurality of threaded bores and a plurality of threaded fasteners for cooperating with the threaded bores for securing multiple electrical services to the tubular body for the purpose of grounding each of the separate electrical services. The grounding block assembly included integral legs that enabled direct attachment of the tubular body to a wall or similar structure. For those situations in which the grounding block assembly was used in conjunction with an electrical service panel or meter can, a threaded nose portion and lock nut on the tubular body enabled direct connection to the service panel or meter can. Side ports were provided in the tubular body for inspection purposes to enable rapid viewing of the integrity of grounding connections therein. The grounding block assembly provided a device for meeting the NEC's requirements for grounding all the electrical systems leading into the home including line voltage, data, cable TV, and phone lines.

Although the grounding block assembly of the parent patent application provided a grounding block assembly for grounding a meter can and connecting multiple services thereto, there still is a need for a device for adding grounding capability to existing grounding wires leading to meter cans and the like. In the present invention, a grounding block assembly is provided for securing onto existing grounded systems in order to provide additional grounding terminals for additional electrical systems such as data, cable TV, and phone lines. The grounding block assembly of the current invention adds an additional advantageous feature by providing a detachable cover constructed of electrically nonconductive material. The detachable insulating cover shields the grounding block and attached wiring thereby protecting the terminals and providing an attractive cover to occlude the view of the wiring and terminals.

SUMMARY OF THE INVENTION

The invention is a grounding terminal block assembly for securing to an existing ground wire to provide additional connection points for electrical systems such data, cable TV, and phone lines. The grounding terminal block assembly includes an elongated grounding bar with a plurality of threaded bores extending laterally therein. Fasteners are threaded into one or more of the threaded bores to provide connection points for ground wires from one or more electrical systems. A channel on one end of the grounding bar includes a slotted headless set screw for establishing a secure connection to an existing ground wire. Legs are provided integral with the grounding bar for providing direct connection to a wall or other structure. A detachable insulating cover is secured to the grounding bar to shield the grounding body and all wiring connections.

OBJECTS AND ADVANTAGES

Several advantages are achieved with the grounding terminal block assembly of the present invention, including:

(1) A plurality of grounding terminals are provided for adding a number of additional connection points to an existing ground wire thereby establishing grounding for a plurality of electrical systems, including phone, data, and cable TV systems.

(2) An open channel is provided at one end of the grounding block assembly to enable rapid connection to an existing installed ground wire.

(3) A main body portion is die cast in one piece of metal alloy with superior electrical conduction properties for establishing proper ground to an existing ground wire.

(4) The grounding terminal block assembly includes integral legs for direct connection to a wall or similar structure.

(5) The grounding terminal block assembly includes a detachable cover constructed of electrically nonconductive material for shielding and protecting the grounding block and its terminals.

(6) After initial installation, the detachable cover can easily be detached in order to connect additional wiring systems to the grounding terminals.

These and other objects and advantages of the present invention will be better understood by reading the following description along with reference to the drawings.

TABLE OF NOMENCLATURE

Figure 1:
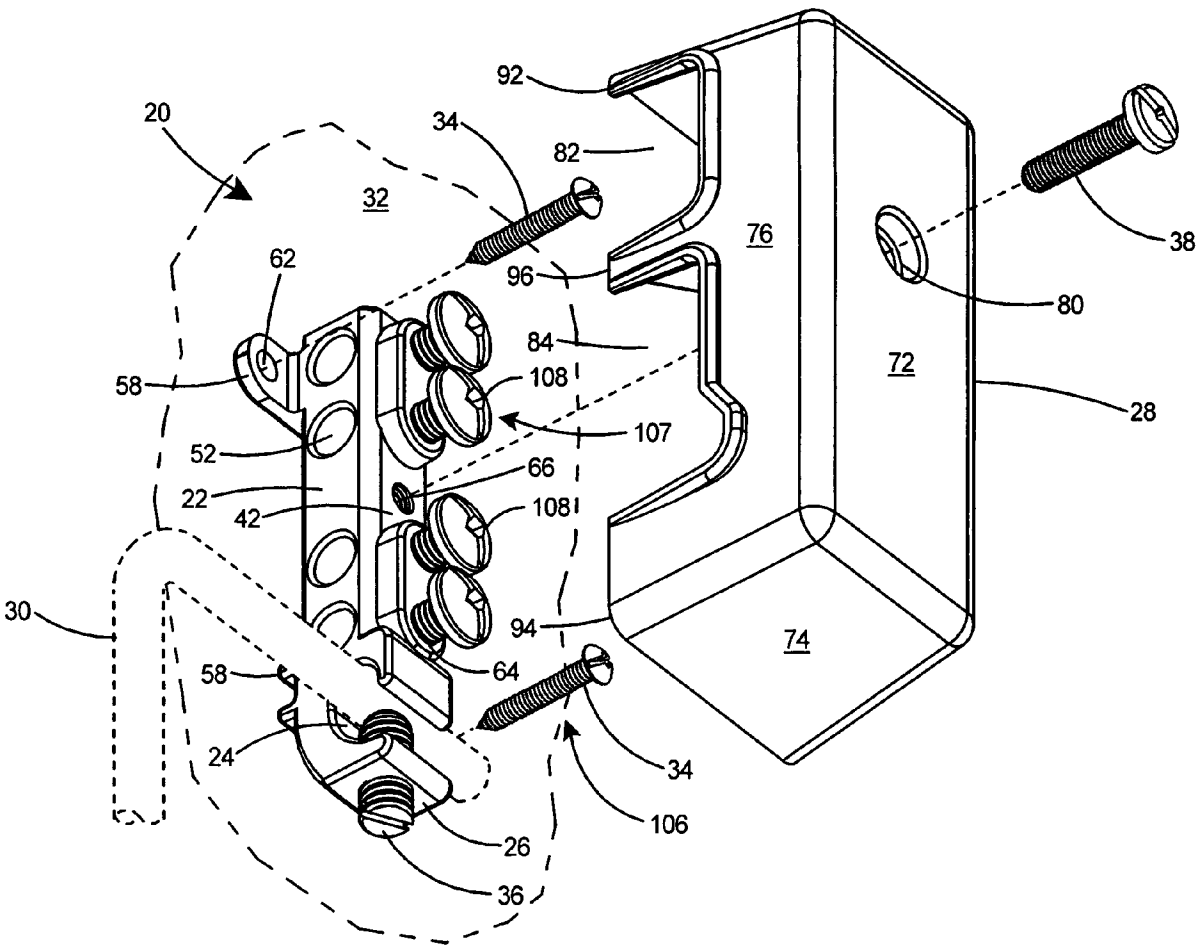
FIG. 1 is an exploded perspective view of a grounding terminal block assembly including a grounding bar portion and a detachable cover according to the present invention.

The following is a listing of part numbers used in the drawings along with a brief description:

Part Number Description

20 grounding terminal block assembly
22 grounding bar
24 open channel
26 first end of grounding bar
28 detachable cover
30 ground wire
32 wall
34 threaded fastener
36 slotted headless set screw
38 cover attachment screw
40 second end of grounding bar
42 front surface of grounding bar
44 rear surface of grounding bar
46 side surface of grounding bar
48 threaded bore
50 boss
52 side bore
53 longitudinal axis through grounding bar
54 wide gap
56 inner seat
58 leg
60 front surface of leg
62 aperture in leg
64 threaded bore in boss
66 central bore in front surface of grounding bar
68 longitudinal rib
70 axis of threaded bore
72 top panel of cover
74 end panel
76 side panel
78 rear edge
80 aperture in cover
82 first side opening
84 second side opening
86 back surface
88 cover boss
90 rear surface of cover boss
92 first end leg
94 second end leg
96 intermediate leg
98 Y-shaped inner support
100 rib
102 longitudinal brace
104 lateral rib
106 mounting arrangement
107 ground wire fastening arrangement
108 threaded fastener or terminal screws
110 filet
112 ground wire
D1 distance across wide gap
$\theta_1$ radius of inner seat portion of open channel

DETAILED DESCRIPTION OF THE INVENTION

With reference to FIG. 1, the present invention comprises a grounding terminal block assembly 20 for attachment to a previously installed ground wire in order to provide several additional grounding terminals for grounding several additional electrical systems to the earth. The grounding terminal block assembly 20 includes an elongated grounding bar portion 22 with an open channel 24 at a first end 26 and a detachable cover 28. In FIG. 1 the grounding bar 22 has been slipped over an existing ground wire 30 by orienting the open channel 24 of the grounding bar 22 with the ground wire 30 and slipping it over the installed ground wire 30. The grounding bar 22 is then secured to the wall 32 with threaded fasteners 34. A slotted headless set screw 36, which is provided as part of the grounding terminal block assembly 20, is then tightened onto ground wire 30 thereby securing the ground wire 30 to the grounding bar 22. Detachable cover 28 is then secured to grounding bar 22 with cover attachment screw 38.

Figure 3:
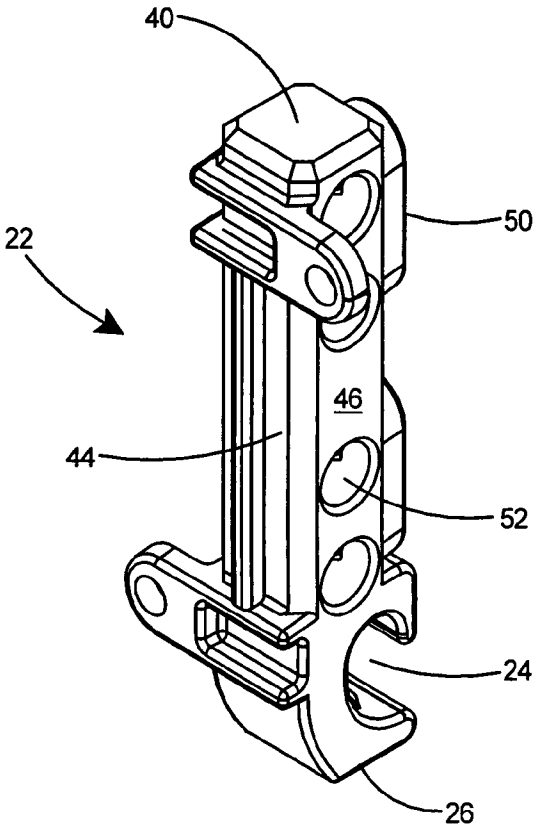
FIG. 3 is a rear perspective view of the grounding bar of FIG. 2.
Figure 2:
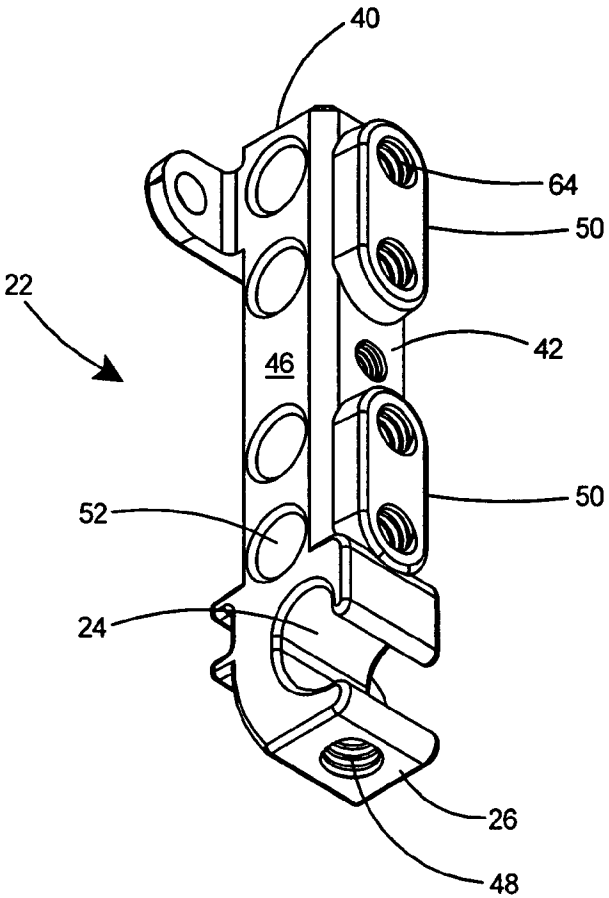
FIG. 2 is a front perspective view of the grounding bar portion of the grounding terminal block assembly of FIG. 1.

Referring to FIGS. 2 and 3, the elongated grounding bar 22 further includes a second end 40, a front surface 42, a rear surface 44, and two side surfaces 46. The elongated grounding bar 22 is preferably constructed of electrically conductive metals. The tubular body is preferably produced in one-piece and is die-cast of metal. A threaded bore 48 extends into the grounding bar 22 at the first end 26.

Figure 4:
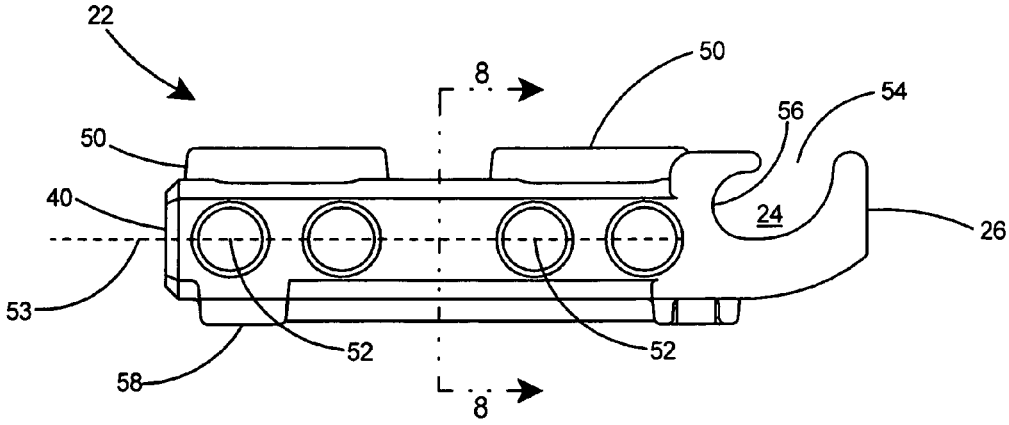
FIG. 4 is a side view of the grounding bar.

With reference to FIG. 4, the grounding bar 22 includes a plurality of bosses 50 extending from the front surface 42. A plurality of side bores 52 aligned along longitudinal axis 53 extend through the grounding bar 22. The front 42, rear 44, and side surfaces 46 of the grounding bar 22 are flat. The open channel 24 in grounding bar 22 includes a wide gap 54 leading therein and an inner seat 56. The wide gap 54 enables the channel 24 portion of the grounding bar 22 to be slipped over a ground wire (not shown) and the ground wire advanced until seated in inner seat 56.

Figure 5:
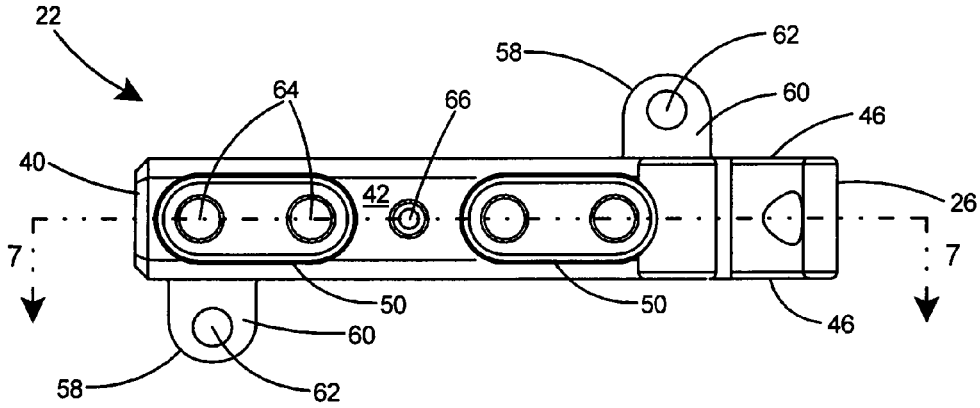
FIG. 5 is a front view of the grounding bar.

As shown in FIG. 5, two legs 58 are integral with and extend outwards from the grounding bar 22 with the legs 58 extending from opposite sides 46 of the grounding bar 22. Each of the legs 58 includes a front surface 60 and an aperture 62 therein. The apertures 62 are at right angles with respect to the front surface 60 of the legs 58 and also with respect to the front surface 42 of the grounding bar 22. A plurality of threaded bores 64 are provided extending into the bosses 50 and a central bore 66 is provided between the two bosses 50 extending into the front surface 42 of the grounding bar 22.

Figure 6:
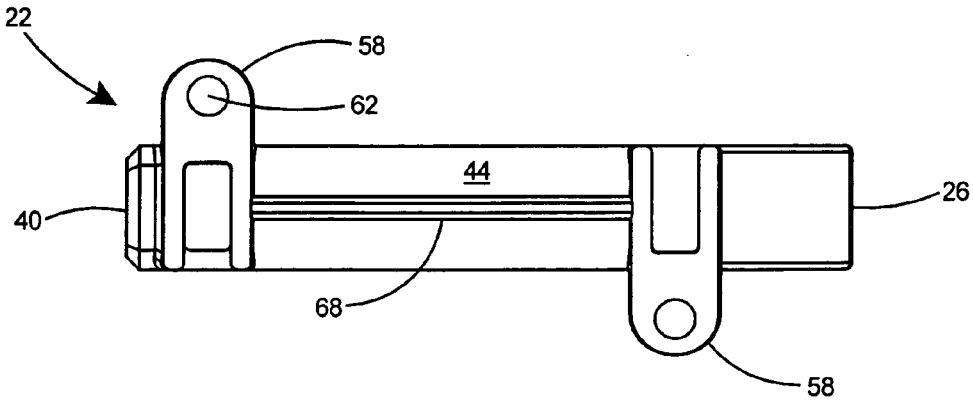
FIG. 6 is a rear view of the grounding bar.
Figure 7:
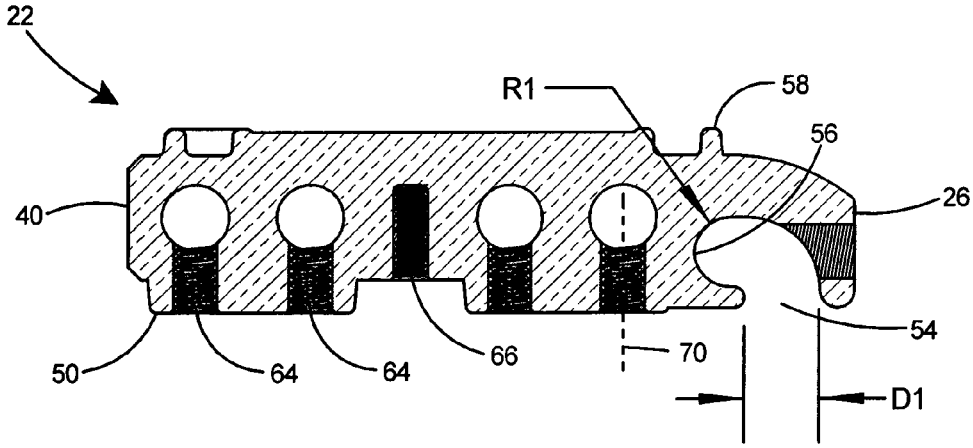
FIG. 7 is a sectional view of the grounding bar taken along line 7-7 of FIG. 5.
Figure 8:
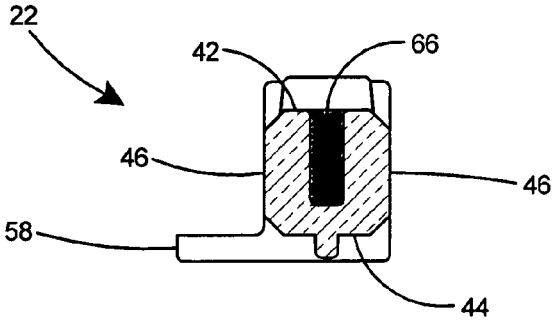
FIG. 8 is a sectional view of the grounding bar taken along line 8-8 of FIG. 4.

Referring to FIGS. 6-8, the rear surface 44 of the grounding bar 22 includes a longitudinal rib 68 extending there from. The longitudinal rib 68 extends between and joins the two legs 58 thereby providing rigidity and support and bracing the legs 58. As shown in FIG. 7, the plurality of threaded bores 64 extend into the grounding bar 22 and include axes 70 that are perpendicular to the front surface 42 of the grounding bar 22.

Figure 10:
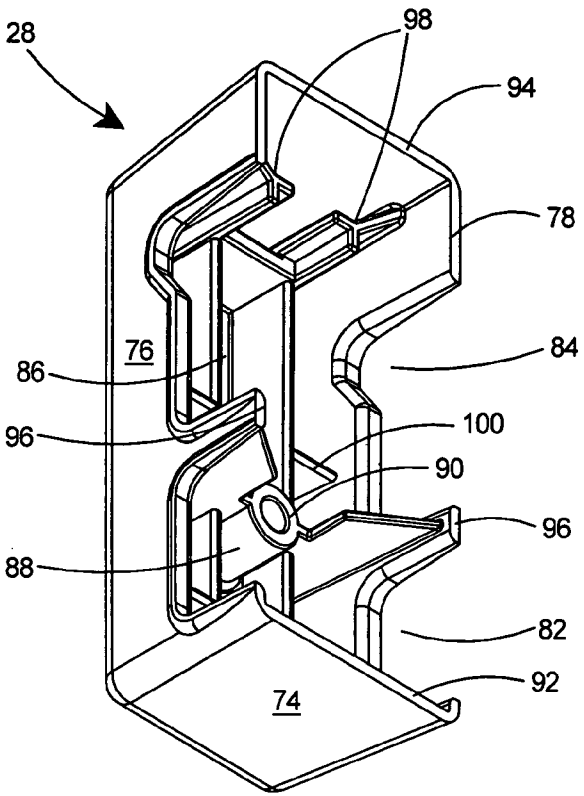
FIG. 10 is a rear perspective view of the detachable cover.
Figure 9:
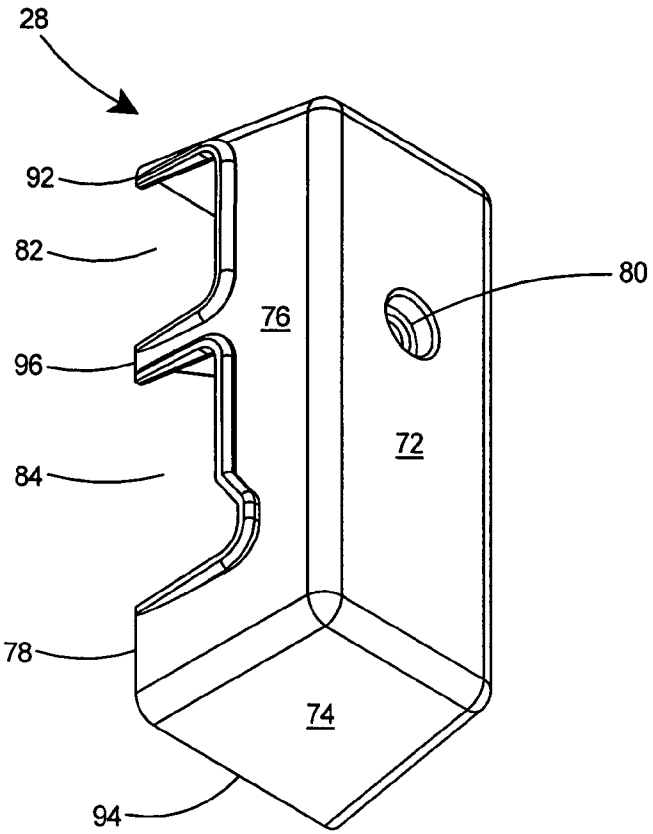
FIG. 9 is a front perspective view of the detachable cover portion of the grounding terminal block assembly of FIG. 1.

With reference to FIGS. 9 and 10, detachable cover 28 includes a top panel 72, end panels 74, side panels 76 and a rear edge 78. Top panel 72 includes an aperture 80 therein and side panels 76 include a first side opening 82 and second side opening 84. The back surface 86 of the top panel 72 includes an integral cover boss 88 projecting therefrom, with cover boss 88 including a rear surface 90. Side openings 82 and 84 divide the cover 28 into a first end leg 92, a second end leg 94, and intermediate legs 96.

Figure 11:
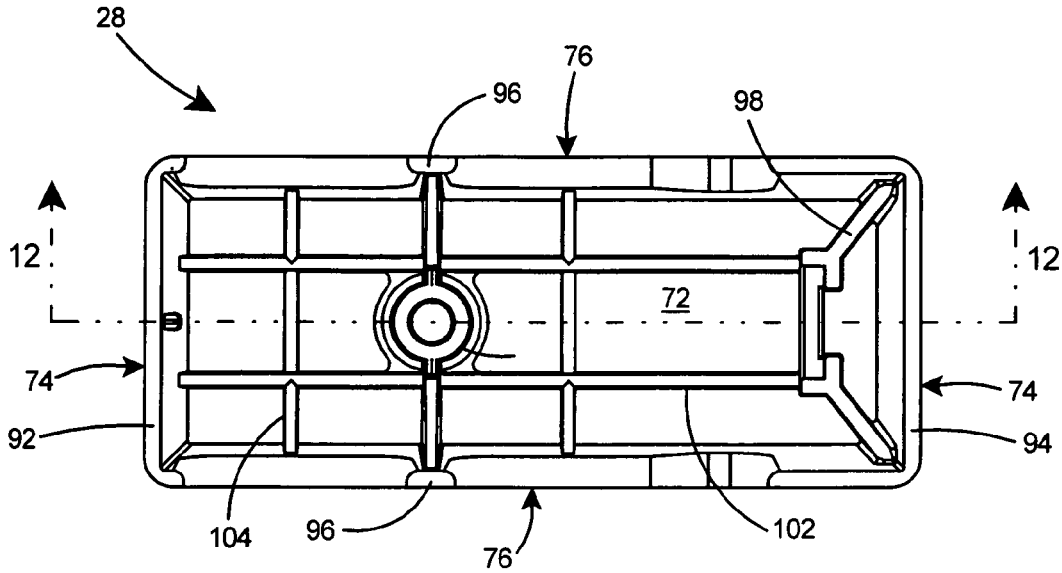
FIG. 11 is a rear view of the detachable cover.
Figure 12:
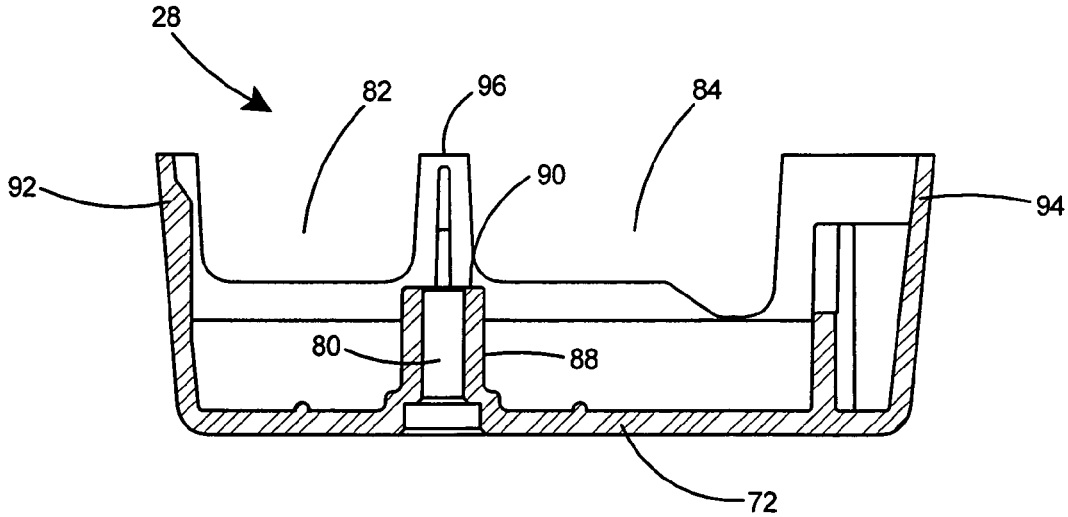
FIG. 12 is a sectional view of the cover taken along line 12-12 of FIG. 11.

Referring to FIGS. 11 and 12, second end leg 94 is braced to said end panel 74 and said side panel 76 by Y-shaped inner supports 98 and intermediate legs 96 are braced by ribs 100 extending from the cover boss 88. A pair of longitudinal braces 102 extends between the Y-shaped inner supports 98 and the first end leg 92 and lateral ribs 104 extend between the side panels 76 and the longitudinal braces 102 to further brace the cover 28.

The grounding bar 22 of the grounding terminal block assembly 20 is preferably constructed of an electrically conductive material. Preferably the grounding bar 22 is constructed of metal with preferred metals including zinc, aluminum, brass, copper, and zinc alloys including aluminum, magnesium, and copper. Most preferably the elongated grounding bar 22 is die cast in one piece from a die-casting alloy. An especially preferred die-casting alloy is Zamak-7.

Reference is made to FIG. 1 for a description of the operation of the present invention. Grounding terminal block assembly 20 includes a mounting arrangement 106 for securing the grounding block 22 to a wall 32 or similar structure. The grounding terminal block assembly 20 is an adjunct grounding block that is designed to be slipped over an existing ground wire 30 as shown in FIG. 1. Initially grounding terminal block assembly 20 includes slotted headless set screw 36 in a loosened state thereby providing a wide gap 54 at the entrance to open channel 24. To operate the grounding terminal block assembly 20, the installer removes the detachable cover 28, aligns the open channel 28 with the ground wire 30, and slips the grounding bar 22 under the ground wire 30 such that the ground wire 30 enters the open channel 24. Slotted headless set screw 36 is then tightened upon ground wire 30 and the grounding bar 22 is mounted to the wall 32 using mounting arrangement 106 consisting of threaded fasteners 34 tightened through apertures 62 in legs 58 of grounding bar 22. After the grounding bar 22 is secured to the ground wire 30 and mounted to the wall 32, then individual ground wires (not shown) are secured to the grounding bar 22 by a ground wire fastening arrangement 107 including a plurality of electrically conductive terminal screws 108. As the grounding bar 22 is die-cast in one piece of electrically conductive material, all ground wires connected to the grounding bar 22 by terminal screws 108 will conduct any voltage surges through the grounding bar 22 to the existing ground wire 30 and thus to earth ground thereby protecting the electrical systems connected by the terminal screws 108.

After the grounding bar 22 is mounted to the wall 32 and ground wires are connected to the grounding bar 22 by the terminal screws 108, detachable cover 28 is secured to the grounding bar 22 by cover attachment screw 38 secured into the central bore 66 in the front surface 42 of grounding bar 22. If only a portion of grounding terminals 108 are in use and additional electrical systems are required to be grounded, detachable cover 28 may be later temporarily removed and additional ground wires connected to the grounding terminals 108, after which the cover 28 is replaced. In case there are more electrical systems to be grounded than available terminal screws 108, additional grounding terminal block assemblies 20 could be connected at other locations along the ground wire 30, in the same manner as described above, to increase the number of available grounding connection points.

Detachable cover 28 is preferably molded in one piece of an electrically insulating material such as plastic. The plastic used to form the detachable cover 28 is preferably polypropylene, polyethylene, polyvinyl chloride (PVC), acrylonitrile-butadiene styrene (ABS), or polycarbonate.

Figure 13:
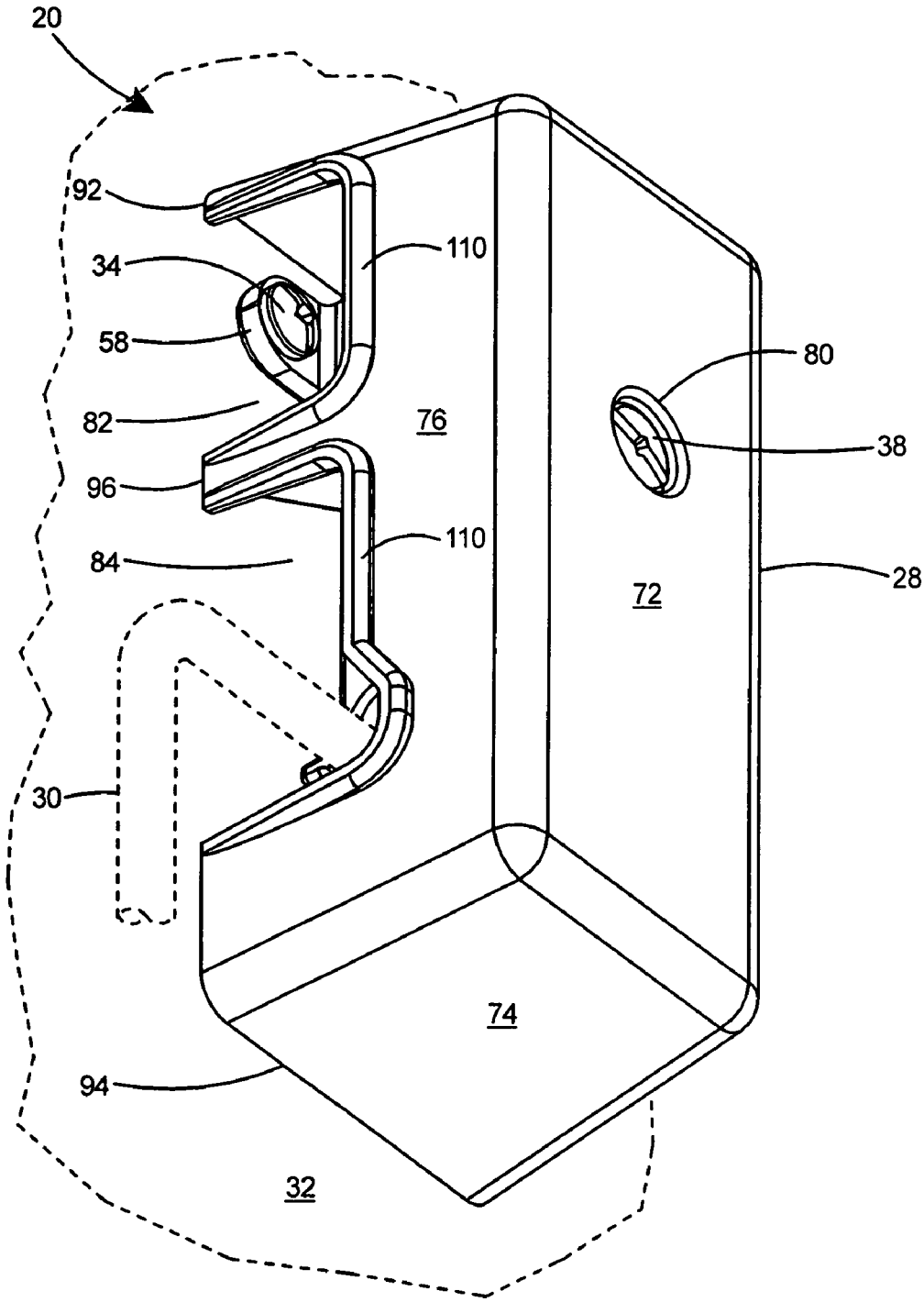
FIG. 13 is a perspective view of a grounding terminal block assembly according to the present invention secured to a wall and with the cover secured to the grounding bar.

With reference to FIG. 13, after the grounding terminal block assembly 20 is secured to a wall 32, first and second side openings 82 and 84 provide entry ports for admitting the main ground wire 30 and ground wires for connection to the individual terminal screws (not shown). Thus, the side openings 82 and 84, included on both sides 76 of the cover 28, enable many different ground wire configurations and connections with the same detachable cover 28. Filets 110 are provided around the peripheries of the side openings 82 and 84 to add rigidity and strength to the side panels 76 of the one piece molded detachable cover.

As shown in FIG. 7, it is critical that the open channel 24 of the grounding bar 22 is sized to accommodate most nominal sizes of ground wires in established grounding systems. Most preferably the radius R1 of the inner seat 56 of open channel 24 is at least 0.165 inch and the distance D1 across the wide gap 54 is at least 0.34 inch.

Figure 14:
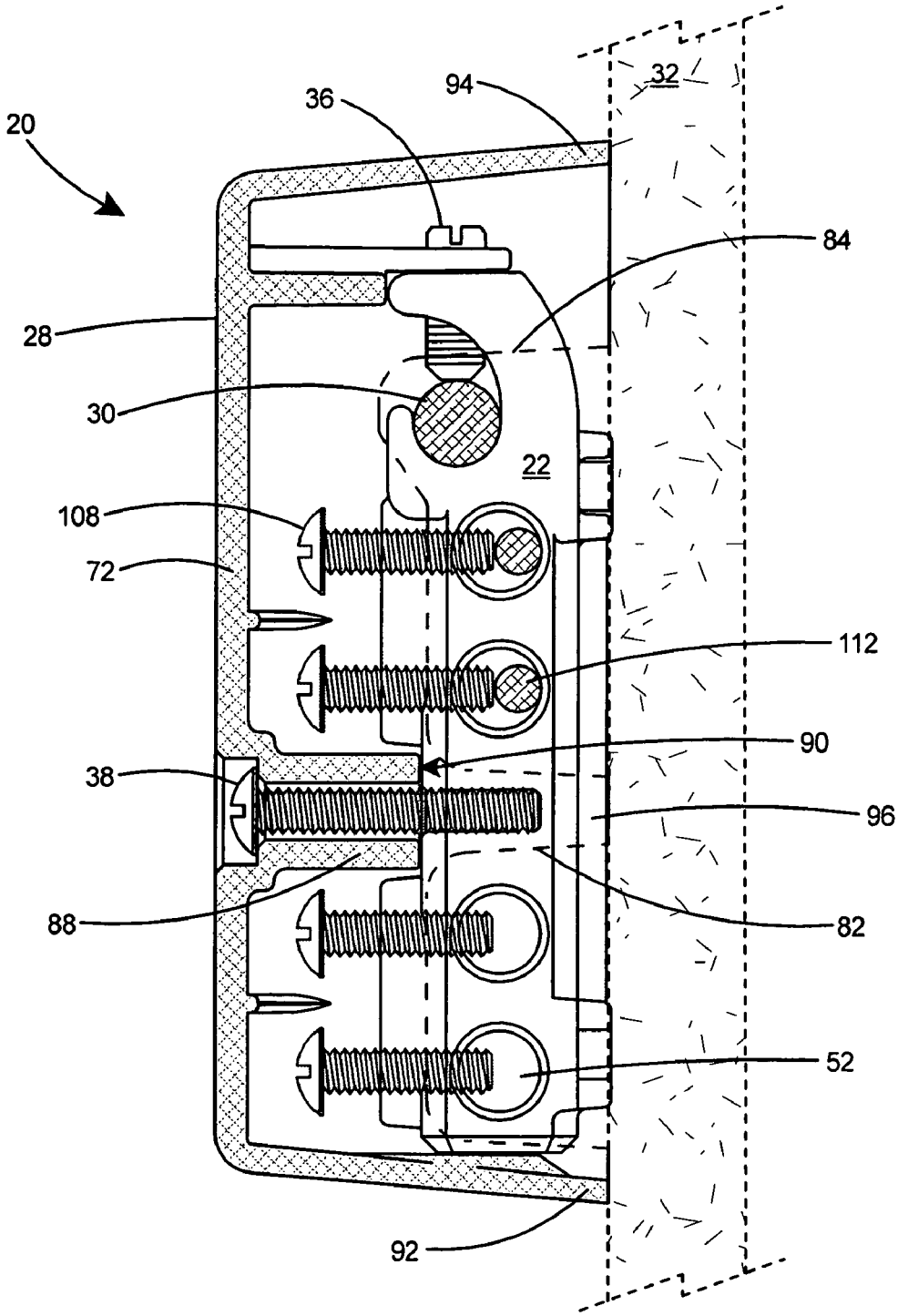
FIG. 14 is a side view of the grounding terminal block assembly secured to a wall and with the cover in sectional view secured to the grounding bar.

Referring to FIG. 14, when the detachable cover 28 is secured to the grounding bar 22, the rear surface 90 of cover boss 88 contacts the front surface 42 of the grounding bar 22. Cover boss 88 therefore positions the top panel 72 of the cover 28 above the grounding bar 22 and provides sufficient space inside the cover 28 for terminal screws 108 whether they have ground wires connected to them or not. The cover boss 88 also positions the first end leg 92, second end leg 94, and intermediate leg 96 flush with the wall 32. First side opening 82 and second side opening 84 (in dashed lines) enable easy viewing of the ground wire 30 to earth and any ground wires 112 that are connected to electrical systems.

Having thus described the invention with reference to a preferred embodiment, it is to be understood that the invention is not so limited by the description herein but is defined as follows by the appended claims.

What is claimed is:

1. A grounding terminal block assembly for multiple services comprising:

an elongated grounding bar including two ends, a front surface, a rear surface, and two side surfaces;

a plurality of threaded bores extending into said grounding bar from said front surface and perpendicular with respect to said front surface;

two legs extending outward laterally from said rear surface of said grounding bar, said legs including flat rear surfaces;

a longitudinal rib extending along and centered on said rear surface of said grounding bar, said longitudinal rib extending between said legs; and a first of said ends of said grounding bar including an open channel extending therein from said front surface.

2. The grounding terminal block assembly of claim 1 including a ground wire fastening arrangement on said terminal block assembly;

said ground wire fastening arrangement including a terminal screw threaded into each of said threaded bores.

3. The grounding terminal block assembly of claim 1 including a plurality of side bores extending through said grounding bar from said side surfaces.

4. The grounding terminal block assembly of claim 1 wherein each of said front, rear, and side surfaces are flat.

5. The grounding terminal block assembly of claim 1 including bosses integral with and extending from said front surface of said grounding bar, said threaded bores extending through said bosses.

6. The grounding terminal block assembly of claim 1 including a mounting arrangement for securing said grounding bar to a wall; and said mounting arrangement including an aperture in each of said legs and a threaded fastener for securing through said apertures in said legs and into the wall.

7. The grounding terminal block assembly of claim 1 wherein each of said legs includes a front surface; and said apertures in said legs are at right angles with respect to said front surface of said legs.

8. The grounding terminal block assembly of claim 1 including a detachable cover for covering said front surface of said grounding bar.

9. The grounding terminal block assembly of claim 8 wherein said front surface of said grounding bar includes a central bore therein;

said detachable cover includes an aperture therein; and a cover attachment screw for securing through said aperture in said detachable cover into said central bore of said grounding bar for securing said detachable cover to said grounding bar.

10. The grounding terminal block assembly of claim 8 wherein said detachable cover includes a front panel, two end panels, and two side panels, said front panel including a back surface; and a first side opening and a second side opening in said side panels.

11. The grounding terminal block assembly of claim 10 wherein said side openings of said detachable cover divide said cover into a first end leg;

a second end leg; and an intermediate leg.

12. The grounding terminal block assembly of claim 11 wherein said detachable cover includes a cover boss extending rearward from said back surface of said front panel; and a rear surface on said cover boss.

13. The grounding terminal block assembly of claim 12 wherein said second leg of said detachable cover is braced to said end panel and said side panel by Y-shaped inner supports; and said intermediate leg is braced by ribs extending from said cover boss.

14. The grounding terminal block assembly of claim 13 wherein said detachable cover includes a pair of longitudinal braces extending between said Y-shaped inner supports and said first end leg; and a lateral rib extending between said side panels and said pair of longitudinal braces.

15. The grounding terminal block assembly of claim 1 wherein said elongated grounding bar is constructed of metal.

16. The grounding terminal block assembly of claim 15 wherein said metal is selected from the group including zinc, aluminum, brass, copper, and zinc alloys including aluminum, magnesium, and copper.

17. The grounding terminal block assembly of claim 1 wherein said elongated grounding bar is die cast in one piece from a die-casting alloy; and said die-casting alloy is Zamak-7.

18. The grounding terminal block assembly of claim 10 including a filet on said side panel of said detachable cover around the periphery of said first side opening and said second side opening.

19. The grounding terminal block assembly of claim 8 wherein said detachable cover is molded in one piece of plastic.

20. The grounding terminal block assembly of claim 19 wherein said plastic is selected from the group including polypropylene, polyethylene, polyvinyl chloride, acrylonitrile-butadiene styrene, and polycarbonate.

* * * * *